US007520143B2

(12) United States Patent
Spilsbury

(10) Patent No.: US 7,520,143 B2
(45) Date of Patent: Apr. 21, 2009

(54) DUAL STAGE NITROGEN REJECTION FROM LIQUEFIED NATURAL GAS

(75) Inventor: Christopher Geoffrey Spilsbury, Haslemere (GB)

(73) Assignee: Air Products and Chemicals, Inc., Allentown, PA (US)

( * ) Notice: Subject to any disclaimer, the term of this patent is extended or adjusted under 35 U.S.C. 154(b) by 475 days.

(21) Appl. No.: 11/409,432

(22) Filed: Apr. 21, 2006

(65) Prior Publication Data

US 2007/0245771 A1 Oct. 25, 2007

(30) Foreign Application Priority Data

Apr. 22, 2005 (EP) ..... 05252524

(51) Int. Cl.
*F25J 3/00* (2006.01)

(52) U.S. Cl. ..... 62/620; 62/927

(58) Field of Classification Search ..... 62/620, 62/927

See application file for complete search history.

(56) References Cited

U.S. PATENT DOCUMENTS

| | | | | |
|---|---|---|---|---|
| 2,500,118 | A | 3/1950 | Cooper | |
| 3,205,669 | A | 9/1965 | Grossmann | |
| 3,559,417 | A | 2/1971 | Hoffman | |
| 3,721,099 | A * | 3/1973 | Forg et al. | 62/612 |
| 3,874,184 | A * | 4/1975 | Harper et al. | 62/628 |
| 4,415,345 | A * | 11/1983 | Swallow | 62/630 |
| 4,455,158 | A * | 6/1984 | Vines et al. | 62/622 |
| 4,504,295 | A | 3/1985 | Davis et al. | |
| 4,701,200 | A | 10/1987 | Fisher et al. | |
| 4,710,212 | A * | 12/1987 | Hanson et al. | 62/630 |
| 5,167,125 | A * | 12/1992 | Agrawal | 62/630 |
| 5,421,165 | A | 6/1995 | Paradowski et al. | |
| 5,617,741 | A | 4/1997 | McNeil et al. | |
| 6,070,429 | A | 6/2000 | Low et al. | |
| 6,199,403 | B1 | 3/2001 | Cole et al. | |
| 6,449,984 | B1 * | 9/2002 | Paradowski | 62/613 |
| 6,763,680 | B2 * | 7/2004 | Fischer et al. | 62/612 |
| 2003/0136146 | A1 | 7/2003 | Wilson et al. | |

(Continued)

FOREIGN PATENT DOCUMENTS

| | | |
|---|---|---|
| EP | 0090469 | 10/1983 |

(Continued)

OTHER PUBLICATIONS

European Search Report completed Sep. 9, 2005.

*Primary Examiner*—William C Doerrler
(74) *Attorney, Agent, or Firm*—Willard Jones, II

(57) ABSTRACT

Nitrogen is removed from a liquefied natural gas feed (41) by a two stage separation in which the liquefied natural gas (41) is first fractionated (23) to provide a first nitrogen-enriched overhead vapour stream (46) and a nitrogen-containing bottoms liquid stream (19) and then at least a portion of said bottoms liquid stream (19) is fractionated (25) to provide a second nitrogen-enriched overhead vapour stream (36) that is of lower purity than said first overhead vapour stream (46) and a purified liquefied natural gas stream (50). The first fractionation is conducted in a distillation column (23) refluxed (45) with nitrogen overhead (43) condensed in a condenser (24) located in a flash drum (25) in which the second fractionation is conducted. The second nitrogen-enriched overhead vapour stream (36) provides fuel gas for use in the natural gas liquefaction plant.

11 Claims, 5 Drawing Sheets

U.S. PATENT DOCUMENTS

| | | | | |
|---|---|---|---|---|
| 2003/0177786 | A1* | 9/2003 | O'Brien | 62/620 |
| 2004/0103687 | A1* | 6/2004 | Clare et al. | 62/621 |
| 2004/0231359 | A1 | 11/2004 | Brostow et al. | |

FOREIGN PATENT DOCUMENTS

| | | |
|---|---|---|
| EP | 0131128 | 4/1987 |
| EP | 0725256 | 8/1996 |
| GB | 2298034 | 8/1996 |
| RU | 2 085 815 C1 | 7/1997 |
| WO | WO 93/08436 | 4/1993 |
| WO | WO 00/23164 | 4/2000 |
| WO | WO 00/58674 | 10/2000 |
| WO | WO 02/088612 | 11/2002 |
| WO | WO 03/004951 | 1/2003 |
| WO | WO 03/062724 | 7/2003 |
| WO | WO 2004/104143 | 12/2004 |
| WO | WO 2005/061978 | 7/2005 |
| WO | WO 2005/061978 A1 | 7/2005 |

* cited by examiner

DUAL STAGE NITROGEN REJECTION FROM LIQUEFIED NATURAL GAS

BACKROUND OF THE INVENTION

The present invention relates to the removal of nitrogen from liquefied natural gas (LNG) streams and use of only part of the nitrogen content in fuel gas whilst the remaining nitrogen content can be vented to atmosphere. There is provided a method in which the nitrogen is removed in two stages at different concentrations and corresponding apparatus for natural gas liquefaction to provide a nitrogen-freed LNG product.

Gas turbines are usually used to provide the shaft work and electrical power for LNG facilities. Fuel for these gas turbines is often generated as off-gasses from the LNG process. In a conventional LNG process, nitrogen present in the feed gas is normally rejected into this fuel gas stream. However, more environmentally friendly low nitrogen oxide (NOX) burners for these turbines have a lower tolerance for nitrogen in the fuel gas than previously used burners. Accordingly, in some plant locations with high nitrogen containing feed gas, more nitrogen will be rejected from the LNG process than can be accepted by the gas turbine fuel system.

There have been a number of prior art proposals for removing nitrogen from LNG as relatively high concentration streams by fractionation in which a refrigeration or heat pump stream is used to condense overhead vapour from the fractionation column or provide reflux to the column.

U.S. Pat. No. 2,500,118 (issued Mar. 7, 1950) discloses a natural gas liquefaction in which an impure LNG feed is separated in a separator to provide an LNG bottoms and a nitrogen overhead. A portion of the nitrogen overhead is condensed to provide reflux to the separator and the balance is vented. There is no further removal of nitrogen from the LNG bottoms of the separator.

U.S. Pat. No. 3,205,669 (issued Sep. 14, 1965) discloses the recovery of helium and nitrogen from natural gas. In the embodiment of FIG. 3, impure LNG bottoms from a "first" separator are separated in a "second" separator into overhead vapour and bottoms liquid. A portion of the overhead provides fuel gas and the remainder is separated in a nitrogen column to provide bottoms liquid and essentially pure nitrogen overhead. The bottoms liquid from the second separator and the nitrogen column are combined and vaporized to provide "residue gas" for further processing. The overhead from the first separator is cooled and fed to a helium separator to provide helium product overhead and a recycle stream. In modifications, described with reference to FIGS. 4 and 5, the nitrogen column is omitted, the overhead from the second separator is fed to the helium separator and nitrogen is obtained as bottoms liquid from the helium separator. In another modification, described with reference to FIGS. 6 and 11/11a, the nitrogen column is retained but the feed to the second separator is from the helium separator. In a further modifications, described with reference to FIGS. 7, 8 and 10, the column is omitted and the feed to the second separator is from the helium separator, whereby nitrogen is not separated from the fuel gas. In all exemplified embodiments, the nitrogen content of the helium separator is less than that of the second separator, which in turn is less than that of the nitrogen column, if present.

U.S. Pat. No. 3,559,417 (issued Feb. 2, 1971) discloses, with reference to FIGS. 1 and 2, separation of nitrogen from a LNG feed in a fractioning column providing purified LNG product as liquid bottoms and nitrogen overhead. A portion of the liquid bottoms provides condensation duty at the top of the column but its composition does not change.

U.S. Pat. No. 3,721,099 (issued Mar. 20, 1973) discloses, with reference to FIG. 1, a fractional condensation of natural gas in which a pre-cooled natural gas feed is separated into a "first" vapour fraction and "first" LNG fraction. The vapour fraction is further cooled and separated to provide a "second" vapour containing about 25% nitrogen and a "second" LNG fraction containing about 5% nitrogen. The second vapour is condensed in a reboiler/condenser to provide reboil duty to the higher pressure ("HP")column of a double rectification column. Part of the condensed mixture is fed to the HP column and the remainder recycled with the "first" LNG fraction to provide refrigeration duty. The HP column provides an overhead vapour containing about 95% nitrogen and a bottoms liquid containing about 5% nitrogen. Part of the overhead provides reboil duty to the lower pressure ("LP") column and resultant condensed overhead provides reflux to that column. The HP column bottoms liquid and the second LNG fraction are separated in the LP column to provide an overhead vapour of about 95% nitrogen and an LNG bottom liquid of about 0.5% nitrogen, which is subcooled and sent to storage. The overheads from the HP and LP columns are combined and used to provide refrigeration duty. In modifications, there is no reflux to the LP column and the overhead vapour from that column contains about 20% nitrogen and provides fuel gas (FIG. 2) and, optionally, (i) all of the condensed vapour from the HP column reboiler/condenser is fed to the HP column (FIG. 3) or (ii) all of the precooled natural gas feed is passed through the HP column reboiler/condenser and is fed to the HP column (FIG. 4).

U.S. Pat. No. 3,874,184 (issued 1, Apr. 1975) discloses the liquefaction of natural gas in which a two-phase stream obtained by partial liquefaction of natural gas is flashed into a fractionator to provide a nitrogen-enriched overhead vapour and an impure LNG bottoms. The overhead is used as fuel gas and the bottoms is flashed and fed to a separator to provide overhead vapour and bottoms liquid. The fractionator is reboiled with vaporized bottoms liquid and the separator is refluxed with sub-cooled bottoms liquid. The bottoms liquid is subsequently flashed and separated in two sequential separators to provide LNG product. The overheads from these separators perform heat exchange duty.

EP-A-0090469 (published Oct. 5, 1983; corresponding to U.S. Pat. No. 4,415,345, issued Nov. 15, 1983) discloses a process in which nitrogen is removed from a gaseous natural gas feed by cooling and fractionating at low pressure using an open-loop nitrogen heat pump to generate liquid reflux for the fractionation. In single column embodiments, only a vapour fraction from partially condensed natural gas feed is subjected to fractionation. Reboil for the fractionation column is provided by condensing the open-loop nitrogen refrigerant and reflux for the column is provided by the condensed nitrogen refrigerant. In exemplified double column embodiments, the higher pressure column is reboiled against partially condensed natural gas feed and the open-loop nitrogen heat pump receives nitrogen from both columns and provides reboil duty to the lower pressure column and reflux to both columns. The purified LNG is warmed against natural gas feed and recovered as vapour. No LNG end product is produced in the process.

EP-A-0131 128 (published Jan. 16, 1985; corresponding to U.S. Pat. No. 4,504,295, issued Mar. 12, 1985) discloses separating a natural gas stream into a nitrogen stream and a methane stream by fractionation of a partially condensed natural gas fraction using a closed cycle heat pump loop to provide reboil and reflux heat exchange duty. No LNG end product is produced in this process.

U.S. Pat. No. 4,701,200 (issued Oct. 20, 1987) discloses the separation of helium from natural gas using a dual-column nitrogen rejection unit in which the HP column overhead is separated into gaseous helium-rich and liquid nitrogen-rich fractions. The former is further separated to provide product helium gas and the latter provides reflux to the HP & LP columns. The HP liquid bottoms is separated in the LP column into LNG bottoms and nitrogen overhead vapour. The natural gas feed to the HP column is gaseous.

WO-A-93/08436 (published Apr. 29, 1993; corresponding to U.S. Pat. No. 5,421,165, issued Jun. 6, 1995) discloses removal of nitrogen from an LNG stream by a process in which the LNG is cooled and expanded both dynamically and statically before fractionation. The cooling is at least partially conducted by heat exchange with a reboiling stream withdrawn from an intermediate location of the column and returned to a level below that intermediate location. The overhead vapour from the fractionation column can be compressed and used as fuel gas. Optionally a portion of the compressed overhead vapour is partially condensed against overhead vapour leaving the column, reduced in pressure and fed to the column as reflux. A portion of the condensed overhead vapour can be fractionated in an auxiliary column to provide high purity nitrogen overhead vapour and bottoms liquid, which is reduced in pressure and combined with the remaining portion prior to feeding to the fractionation column. The auxiliary column bottoms liquid can be used to provide condensation duty at the top of the auxiliary column.

EP-A-0725256 (published Aug. 7, 1996) discloses a process in which a gaseous natural gas feed is cooled and fractionated to remove nitrogen. Reboil vapour for the fractionation column is provided by cooling an open-loop nitrogen gas refrigerant in the column reboiler. Reflux for the top of the column is provided by work expanding the cooled nitrogen refrigerant gas to provide a small amount (4-5%) of liquid. At least one intermediate vapour stream from the column is partially condensed against an overhead nitrogen vapour stream and returned to the column as intermediate reflux, which is the bulk of the reflux to the column. The natural gas is pumped to a higher pressure prior to warming and is recovered as a vapour product. No LNG end product is produced in the process.

GB-A-2298034 (published Aug. 21, 1996; corresponding to U.S. Pat. No. 5,617,741, issued Apr. 8, 1997) discloses a process for removing nitrogen from a natural gas feed stream using a dual column cryogenic distillation system having a primary column and a secondary column fed from and operating at substantially the same pressure as the primary column. At least a portion of a bottoms liquid from the primary column is expanded and at least partially vaporized in heat exchange with a nitrogen-enriched vapour from the column to provide an at least partially condensed nitrogen-enriched stream that is returned to the primary column to provide higher temperature reflux. Bottoms liquid from the secondary column is at least partially vaporized in heat exchange with an overhead vapour from one of the columns to provide an at least partially condensed stream that is returned to the primary or secondary column to provide lower temperature reflux. Reboil to the columns is provided by heat exchange with natural gas feed. No LNG end product is produced in this process.

WO-A-0023164 (published Apr. 27, 2000; corresponding to U.S. Pat. No. 6,199,403, issued Mar. 13, 2001) discloses a process in which a natural gas stream is liquefied, expanded and then separated in a phase separator, which can be a nitrogen-rejection column. Reflux for the column can be provided by condensing a portion of the overhead vapour using a refrigeration system. The refrigeration system can comprise a closed-loop refrigeration system; an open-loop refrigeration system; and/or indirect heat exchange with a product stream. Some of the heat exchanger duty to condense the overhead vapour can be provided by a bottoms liquid stream withdrawn from and returned to the column. The separated LNG product liquid is pumped to a higher pressure and warmed.

U.S. Pat. No. 6,070,429 (issued Jun. 6, 2000; corresponding to WO-A-0058674, published Oct. 5, 2000) discloses a process in which a pressurized gas stream obtained from a pressurized LNG-bearing stream is separated in a cascade of 3 stripping columns at successively lower pressures to produce, from the third stripping column, a nitrogen-rich gas stream and a methane-rich liquid stream, which latter stream is suitable for recycle to an open methane cycle liquefaction process and/or use as a fuel gas. In each stripping column, a liquid bearing stream obtained by partial condensation of a first portion of a gas stream is contacted in countercurrent with a second portion of the respective gas stream to provide an overhead vapour and bottoms liquid. The overhead vapours of the first and second stripping columns provide the feed streams for the second and third stripping columns respectively. Condensation duty for the feed streams to the second and third stripping columns is provided by the overhead vapour and bottoms liquid from the third stripper. In exemplified embodiments, bottoms liquid from the second stripping column is fed to the third stripping column and the bottoms liquid from the first stripping column can be used to provide heat exchange duty to provide the partially condensed feed portion to the first stripping column.

U.S. Pat. No. 6,449,984 (issued Sep. 17, 2002; corresponding to WO-A-03004951, published Jan. 8, 2003) discloses a process in which a natural gas stream is liquefied and then fractionated to provide a nitrogen-enriched overhead vapour and LNG bottoms liquid. Reflux for the fractionation column is provided by condensing a portion of the overhead vapour. In the exemplified embodiments, the condensing duty is provided by a refrigerant stream and is integrated with a final LNG subcooling heat exchanger. Also in these embodiments, liquid is withdrawn from an intermediate location of the fractionation column, warmed against the liquefied gas stream feed to the column and returned to the column at a lower location.

WO-A-02088612 (published Nov. 7, 2002) discloses a process for removing nitrogen from a hydrocarbon-rich stream, especially natural gas, during liquefaction in which the partially condensed stream is fed to a double column nitrogen-rejection system. The higher pressure column provides a nitrogen-rich overhead vapour that is condensed against overhead vapour from the lower pressure column and fed as reflux to the lower pressure column. Bottoms liquid from the higher pressure column is cooled and fed to the lower pressure column, from which liquefied product is withdrawn as bottoms liquid. The higher pressure column is reboiled with heat duty provided by the partially condensed feed to the higher pressure column.

U.S. 2003/013146 (published Jul. 24, 2003; corresponding to WO03062724, published Jul. 31, 2003) discloses an integrated process for producing LNG and GTL (gas-to-liquids technology) products in which LNG feed is seperated in sequential flash drums or other separators to provide respective overhead vapours and increasingly purified LNG bottoms. The separator overheads are used as fuel, GTL feedstock or recycle streams. It is preferred that each successive separation is at least 15 psig (1 barg) less than the preceding separation U.S. Pat. No. 2004231359 (published th Nov. 25 2004; corresponding to WO2004104143, published Dec. 2, 2004) discloses a process in which a natural gas stream is liquefied and then fractionated in a distillation column to remove nitrogen as an overhead vapour product and purified LNG as bottoms liquid. Reflux for the column is provided by a condensed nitrogen stream. Refrigeration to provide the reflux stream and cooling the purified LNG stream and/or the liquefied natural gas feed is obtained by compressing and work expanding a refrigerant stream comprising nitrogen that may comprise all or a portion of the overhead vapour from the distillation column. In the exemplified embodiments, heat exchange duty for reboil to the fractionation column is provided by the liquefied natural gas feed to the column.

WO-A-2005/061978 (published Jul. 7, 2005) discloses removing nitrogen from a LNG feed stream by a first fractionation providing a nitrogen-enriched overhead ("first vapour stream")and a nitrogen-depleted bottoms liquid ("first liquid stream") and subjecting the bottoms liquid to a second fractionation to provide a nitrogen-enriched overhead ("second vapour stream") of lower purity than the first vapour stream and purified LNG ("second liquid stream"). The fractionations can be conducted in columns or flash drums. The second fractionation is carried out at a lower pressure than the first fractionation and the first liquid stream can be cooled by expansion, preferably to or near atmospheric pressure. The first vapour stream is consumed, for example as gas turbine fuel, and is produced in an amount that does not exceed that which can be consumed in the relevant plant. The only use specified for the second vapour stream is as domestic gas. Preferably, the first vapour stream has a nitrogen content of 10 to 30 mol % and the second vapour stream has a nitrogen content of less than 5.5 mol %.

BRIEF SUMMARY OF THE INVENTION

It is an object of the present invention to provide for reject of part of the nitrogen from any LNG process with minimal additional equipment and minimum impact on plant performance. This can be achieved by the invention without any changes to the configuration of the heat transfer equipment for the production of LNG and with limited additional equipment. In particular, the invention avoids the necessity of an additional heat pump compressor and permits end product LNG to be used to operate a nitrogen separation column condenser.

The invention provides a method of preparing a nitrogen-freed liquefied natural gas stream comprising liquefying a nitrogen-containing natural gas, using work provided by a gas turbine, to provide a nitrogen-containing liquefied natural gas stream and subjecting the liquefied natural gas to a first fractionation in a distillation column to provide a first nitrogen-enriched overhead vapour stream and a nitrogen-containing bottoms liquid stream; sub-cooling, using refrigeration duty provided by a refrigerant fluid not derived from the liquefied natural gas feed, and pressure reducing at least a portion of said bottoms liquid stream; subjecting said sub-cooled, pressure reduced portion to a second fractionation in a flash drum to provide a second nitrogen-enriched overhead vapour stream that is of lower purity than said first overhead vapour stream and a purified liquefied natural gas stream; condensing a portion of the first nitrogen-enriched overhead vapour stream in said flash drum to provide heat duty therein and produce a condensed nitrogen-enriched overhead stream; and returning at least a portion of said condensed nitrogen-enriched overhead stream as reflux to the distillation column, and the second, but not the first, of said nitrogen-enriched overhead vapour streams is used as, or added to, a fuel gas used in said gas turbine providing work for use in connection with liquefaction of the natural gas feed.

The invention also provides an apparatus for preparing a nitrogen-freed liquefied natural gas stream by a process of the invention, said apparatus comprising:

- a refrigeration system for liquefying the nitrogen-containing natural gas feed;
- a gas turbine providing work for use in connection with said refrigeration system;
- a distillation column;
- a flash drum;
- a condenser within said flash drum;
- a heat exchanger for receiving refrigeration duty from a refrigeration fluid;
- conduit means for feeding nitrogen-containing liquefied natural gas from the refrigeration system to the distillation column;
- conduit means for removing the first nitrogen-enriched overhead vapour stream from the distillation column;
- conduit means for conveying a portion of the first nitrogen-enriched overhead vapour stream to the condenser;
- conduit means for returning condensed first nitrogen-enriched overhead vapour stream from the condenser to the distillation column as reflux;
- conduit means for conveying the nitrogen-containing bottoms liquid stream from the distillation column to the heat exchanger;
- conduit means for conveying the sub-cooled nitrogen-containing bottoms liquid stream from the heat exchanger to the flash drum at reduced pressure;
- conduit means for removing the second nitrogen-enriched overhead vapour stream from the flash drum;
- conduit means for removing the purified liquefied natural gas stream from the flash drum and
- conduit means for feeding the second nitrogen-enriched overhead vapour stream to the gas turbine as a fuel gas feed thereto.

DETAILED DESCRIPTION OF THE INVENTION

Figure 1:
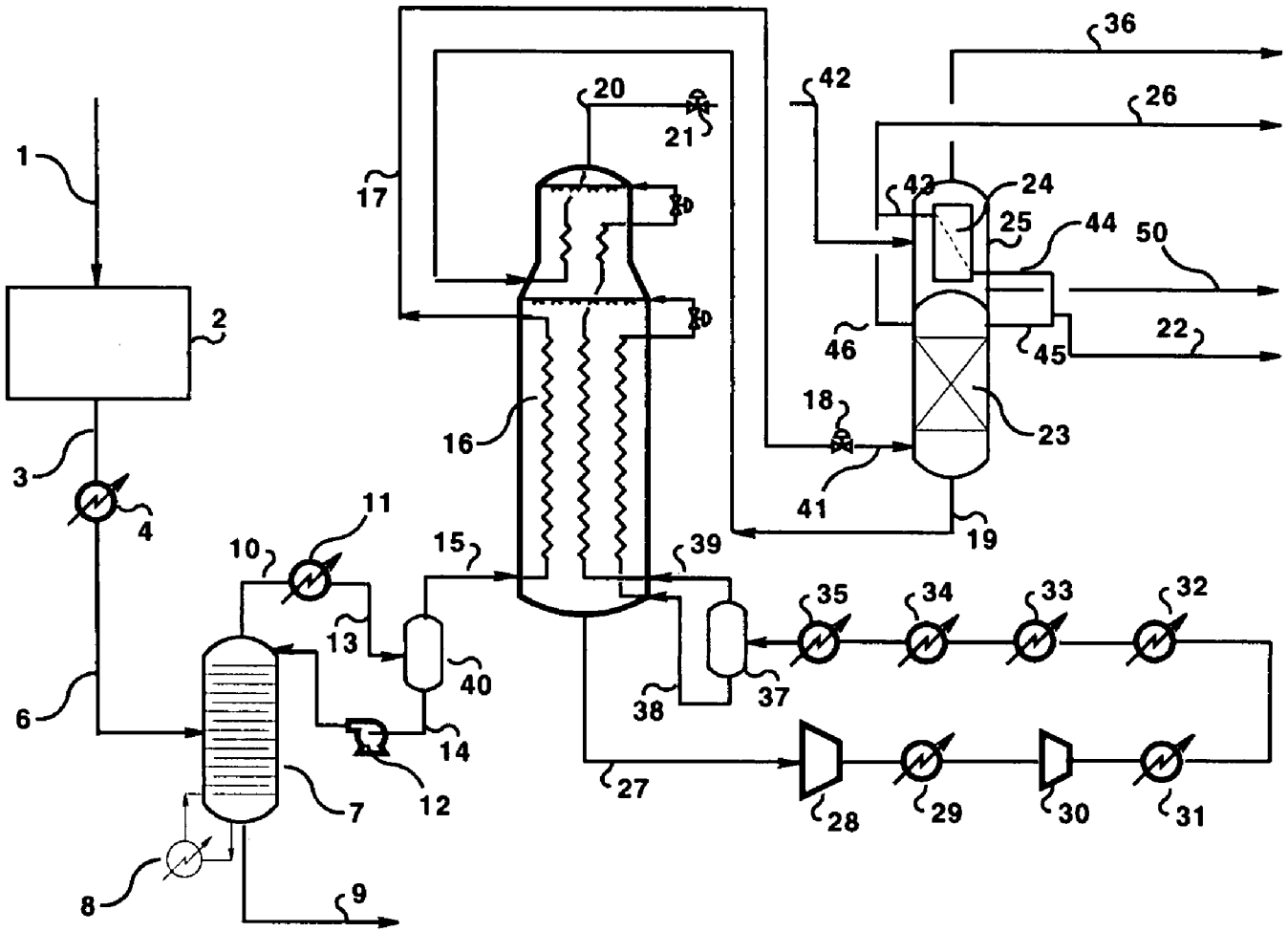
FIG. 1 is a simplified process flow diagram showing the basic principal applied to a propane precooled mixed refrigerant (C3MR) LNG plant using a single spool wound heat exchanger for liquefaction and subcooling.

In the invention nitrogen is removed from a liquefied natural gas feed by subjecting the liquefied natural gas to a first fractionation in a distillation column to provide a first nitrogen-enriched overhead vapour stream and a nitrogen-containing bottoms liquid stream and subjecting at least a portion of said bottoms liquid stream to a second fractionation in a flash drum to provide a second nitrogen-enriched overhead vapour stream that is of lower purity than said first overhead vapour stream and a purified liquefied natural gas stream.

The first nitrogen-enriched-overhead vapour stream can have a nitrogen concentration in excess of 80 mol %, preferably in excess of 90 mol % and more preferably in excess of 95 mol %.

Usually, at least a portion of the first nitrogen-enriched overhead vapour stream is vented to atmosphere. The second nitrogen-enriched overhead vapour stream is used as, or added to, a fuel gas, for a gas turbine providing work for use in connection with liquefaction of the natural gas feed.

The distillation column is refluxed with first nitrogen-enriched overhead vapour condensed in a condenser located in the flash drum using heat exchange duty for the condensation provided by all or a portion of the nitrogen-containing bottoms liquid stream after sub-cooling and pressure reduction. The distillation column can be reboiled by heat exchange duty provided by the liquefied natural gas feed.

When only a portion of the nitrogen-containing bottoms liquid stream is required for condensation duty, the remainder can be fed to a second flash drum for separation into a third nitrogen-enriched overhead vapour stream that is of lower purity than said first overhead vapour stream and a second purified liquefied natural gas stream. Usually, said third nitrogen-enriched overhead vapour stream will be combined with the second nitrogen-enriched overhead vapour stream and said second purified liquefied natural gas stream will be combined with the purified liquefied natural gas stream from the second fractionation.

If the liquefied natural gas feed stream contains helium, a helium-rich stream can be separated from a stream comprising or derived from the first nitrogen-enriched overhead vapour stream by, for example, partial condensation and separation to provide a helium-enriched vapour and a nitrogen-enriched liquid. The heat exchange duty for said partial condensation can be provided by the separated helium-enriched vapour and/or nitrogen-enriched liquid.

A preferred embodiment comprises:

feeding a nitrogen-containing natural gas stream to a spiral-wound heat exchanger having liquefaction and sub-cooling sections in which heat exchanger refrigeration duty is provided by a recycling refrigerant system to which work is supplied by a gas turbine powered by a fuel gas;

withdrawing a liquefied gas stream after said liquefaction section;

subjecting said liquefied gas stream to a first fractionation in a distillation column to provide a first nitrogen-enriched overhead vapour stream and a nitrogen-containing bottoms liquid stream;

sub-cooling at least a portion of said bottoms liquid stream in said sub-cooling section and pressure reducing said portion;

subjecting said pressure-reduced portion to a second fractionation in a flash drum to provide a second nitrogen-enriched overhead vapour stream that is of lower purity than said first overhead vapour stream and a purified liquefied natural gas stream;

condensing a portion of the first nitrogen-enriched overhead vapour stream in said flash drum to provide heat duty therein and produce a condensed nitrogen-enriched overhead stream;

returning at least a portion of said condensed nitrogen-enriched overhead stream as reflux to the distillation column and using said second nitrogen-enriched overhead vapour stream, but not said first nitrogen-enriched overhead vapour stream, as at least a component of the fuel gas.

The invention also provides an apparatus for preparing a nitrogen-freed liquefied natural gas stream by a process of said second aspect, said apparatus comprising:

a refrigeration system for liquefying the nitrogen-containing natural gas feed;

a gas turbine providing work for use in connection with said refrigeration system a distillation column;

a flash drum;

conduit means for feeding nitrogen-containing liquefied natural gas from the refrigeration system to the distillation column;

conduit means to remove the first nitrogen-enriched overhead vapour stream from the distillation column;

conduit means for conveying a portion of the first nitrogen-enriched overhead vapour stream to the condenser;

conduit means for returning condensed first nitrogen-enriched overhead vapour stream from the condenser to the distillation column as reflux;

conduit means for conveying the nitrogen-containing bottoms liquid stream from the distillation column to the heat exchanger;

conduit means for conveying the sub-cooled nitrogen-containing bottoms liguid stream from the heat exchanger to the flash drum at reduced pressure;

conduit means for removing the second nitrogen-enriched overhead vapour stream from the flash drum;

conduit means for removing the purified liquefied natural gas stream from the flash drum; and conduit means for feeding the second nitrogen-enriched overhead vapour stream to the gas turbine as a fuel gas feed thereto.

In accordance with a preferred embodiment of the present invention, natural gas which has been liquefied at pressure but not yet fully cooled to its storage conditions is let down to an intermediate pressure and fed into the distillation column. The flashing of the LNG stream into this column results in the bottoms liquid having reduced nitrogen content. The quantity of this reduction is as desired by the objective of reducing the nitrogen content of the final fuel gas. LNG withdrawn from the bottom of this column is further cooled to the temperature required by the end flash system to produce LNG of the final desired nitrogen content and fuel gas of the required heating value. This finally cooled LNG is sent to an end flash drum. The end flash drum contains a heat exchanger which is used to condense the nitrogen-separation column overhead vapour stream and provide reflux to this column. The overhead vapour of this column is a nitrogen stream which can be vented directly to atmosphere.

The overhead vapour condenser to the column may be integrated into the end flash drum of the process in which case all product LNG passes through this drum. Optionally only a portion of the LNG product may pass through this drum.

The distillation column can have a reboiler which is reboiled by the LNG feed to the column before it is let down in pressure, optionally via a fluid expander.

The nitrogen product from the top of the column can be expanded and have refrigeration recovered from it into a stream being cooled or liquefied in the LNG process.

The invention is particularly useful for LNG plants which use spiral wound heat transfer equipment for LNG liquefaction. It requires only withdrawing the nitrogen-containing LNG after the liquefaction section and returning it at lower pressure and nitrogen depleted into the subcooling section and access end product LNG for refrigeration. For C3MR processes, this can be achieved simply by withdrawing and returning LNG between penultimate and ultimate refrigeration stages and using rundown LNG. Similarly for AP-X™, LNG can be withdrawn and returned between the Main Cryogenic Heat Exchanger and the subcooler and using rundown LNG.

Almost any portion of the nitrogen contained in the feed gas can be rejected as a pure nitrogen stream by this invention.

The exemplified embodiments of the invention can be applied to any LNG liquefaction process in which there is a liquefaction section followed by a subcooling section. For example, it can be applied to double or dual mixed refrigerant (DMR) and hybrid C3MR pre-cooling and liquefaction with nitrogen expander cycle LNG subcooling (AP-X™) processes as well as the illustrated C3MR process. The LNG is extracted between liquefaction and subcooling sections, fed to a nitrogen-separation column where nitrogen is rejected 'pure'. The LNG is returned to the subcooling section after which some of the cold in the product LNG is used to operate the nitrogen-separation column condenser Referring to FIG. 1, a feed natural gas stream 1 is pretreated in pre-treatment unit 2 to remove impurities such as water and carbon dioxide that would otherwise freeze in low temperature sections of the plant. The resultant impurities-freed feed gas 3 is precooled in one or more heat exchangers 4 after which it is passed into separation column 7. The heat exchanger(s) can be a series of heat exchangers (4, 5—see FIGS. 2 & 3) in which, for example, propane refrigerant is vaporized at successively lower pressures to cool stream 3 or a single heat exchanger (4—see FIGS. 1 & 4) in which a mixed refrigerant is vaporized. Column 7 separates the vaporized stream 6 into a lighter overhead vapour fraction 10 and a heavier bottoms liquid fraction 9, which contains heavier components which are not desired in the LNG product. The overhead vapour 10 is partially condensed against a refrigerant in condenser 11. The partially condensed stream 13 is separated in separator 40 to provide a liquid condensate 14, which is returned, via pump 12, to the separation column 7 as reflux, and a overhead vapour 15, which is fed to spool wound heat exchanger 16. The overhead vapour is further cooled in a first section of the heat exchanger 16 to a temperature at which the cooled stream 17 will remain substantially liquid when reduced to an intermediate pressure by expansion valve or expansion turbine 18. The cooling in the heat exchanger 16 takes place against a mixed refrigerant stream which exits heat exchanger 16 as stream 27.

The mixed refrigerant is compressed in one or more compressors 28,30. The compressed mixed refrigerant is first cooled against a cooling medium in cooler 31 and then further cooled and partially condensed against a first level pre-cooling refrigerant in coolers 32-35. Partially condensed refrigerant is separated in separator 37 and both vapour and liquid fractions supplied to the liquefaction heat exchanger 16.

After pressure reduction, the stream 41 is separated in nitrogen-rejection column 23 to provide bottoms liquid. 19 and overhead vapour 46. The bottoms liquid 19 has reduced nitrogen content compared with the feed 41 to the column 23 and is further cooled in a second part of the heat exchanger 16 against a mixed refrigerant to a temperature at which it will remain substantially liquid when lowered to the pressure desired for the LNG product. The cold LNG stream 20 is reduced in pressure across an expansion valve 21 and the low pressure stream 42 is passed into flash drum 25 in which it is partially vaporized to provide a liquid product LNG fraction 50 and a vapour fuel fraction 36. Heat exchange duty in the flash drum 25 is provided by a heat exchanger 24 in which a portion 43 of the overhead vapour stream 46 from the nitrogen-rejection column 23 is condensed. The remainder 26 of the overhead vapour stream 46, which is relatively high purity nitrogen, is vented to atmosphere. Condensed nitrogen 44 from the heat exchanger 24 is returned to the nitrogen-rejection column 23 as reflux 45. Optionally a liquid nitrogen stream 22 can be withdrawn from the condensed stream 44 leaving condenser 24.

Figure 2:
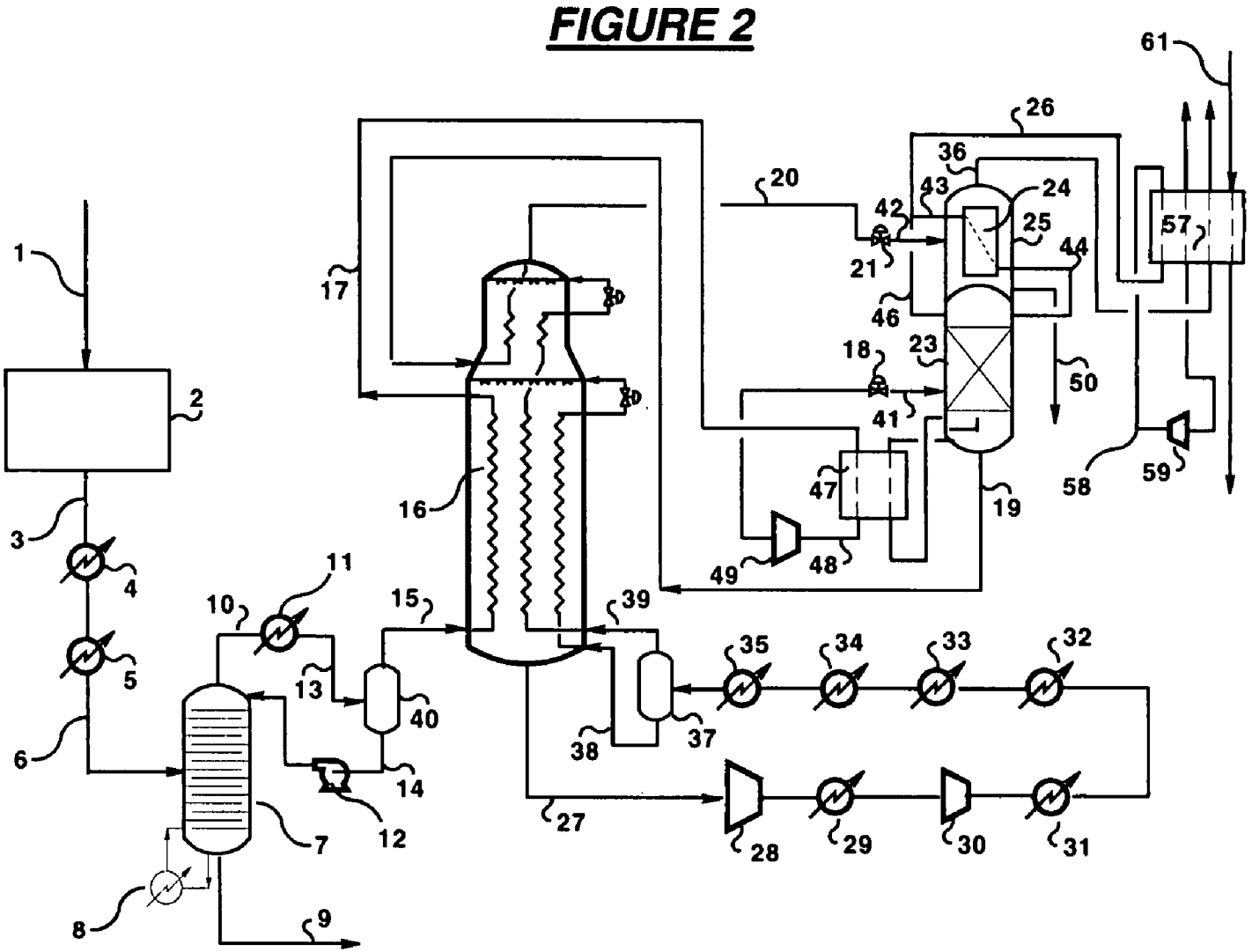
FIG. 2 a simplified process flow diagram showing a modification of the embodiment of FIG.1 incorporating a reboiler for the nitrogen-rejection column, an expander for the feed to that column, and a heat exchanger to recover refrigeration from the overheads vapours.

The embodiment of FIG. 2 differs from that of FIG. 1 in that a reboiler 47 has been added to the nitrogen-rejection column 23, an expander 49 has been added to expand the feed to the column 23, and a heat exchanger 57 has been added to recover refrigeration from the overhead vapour portion 26 from the column 23 and/or the overhead vapour portion from the flash drum 25. However, each of these features can be used separately or in any combination in conjunction with the nitrogen-rejection column 23.

The reboiler 47 is located at the bottom of column 23 to increase the quantity of nitrogen rejected by that column. The cooled high pressure feed gas 17 from the first section of heat exchanger 16 is used to provide heat duty in reboiler 47 and the resultant stream 48 leaving the reboiler 47 is expanded in the expansion turbine 49 prior to passing into column 23.

Refrigeration can be recovered from either or both of the overheads vapours 26 & 36 from column 23 and flash drum 25. This can be done by passing the relevant stream(s) to a heat exchanger 57 and, if required expanding the warmed overhead vapour 58 from the nitrogen-rejection column in a turboexpander 59. The stream 61 cooled by the refrigeration recovered in the heat exchanger 57 can be a sidestream of feed gas or circulating refrigerant.

Figure 3:
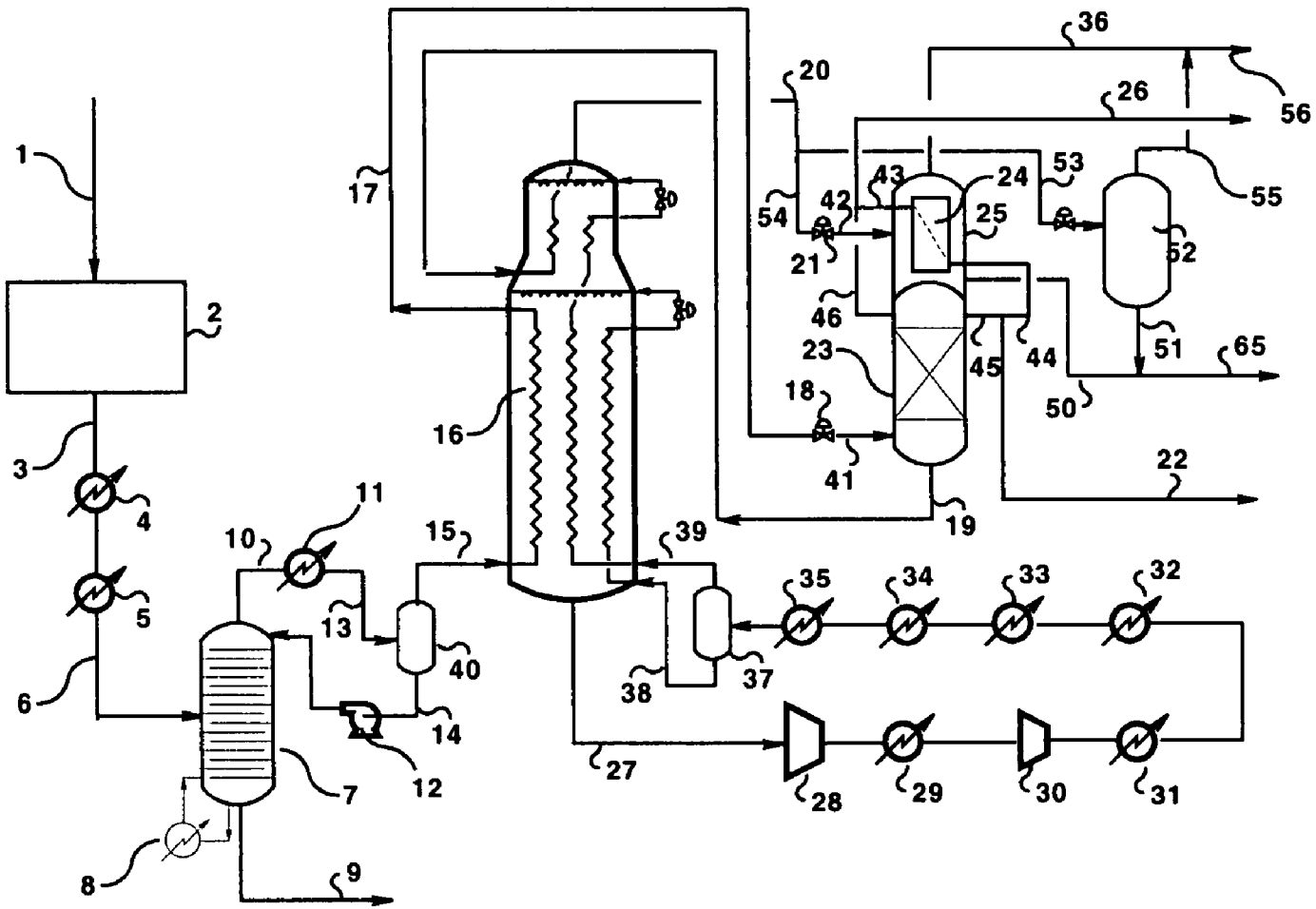
FIG. 3 a simplified process flow diagram showing a modification of the embodiment of FIG. 1 in which only a portion of the LNG stream is used to provide condensation duty.

The embodiment of FIG. 3 differs from that of FIG. 1 in that not all the cold LNG stream 20 passes through the flash drum 25. Instead, it is divided into a first stream 53, which is let down into a second flash drum 52, and a second stream 54 that is let down into flash drum 25. Vapour leaving flash drums 25 and 52 are collected and combined into a stream 56, which is sent to the fuel gas system. LNG liquid streams 50 and 51 leaving flash drums 25 and 52 are combined and sent to LNG storage as stream 65.

Figure 4:
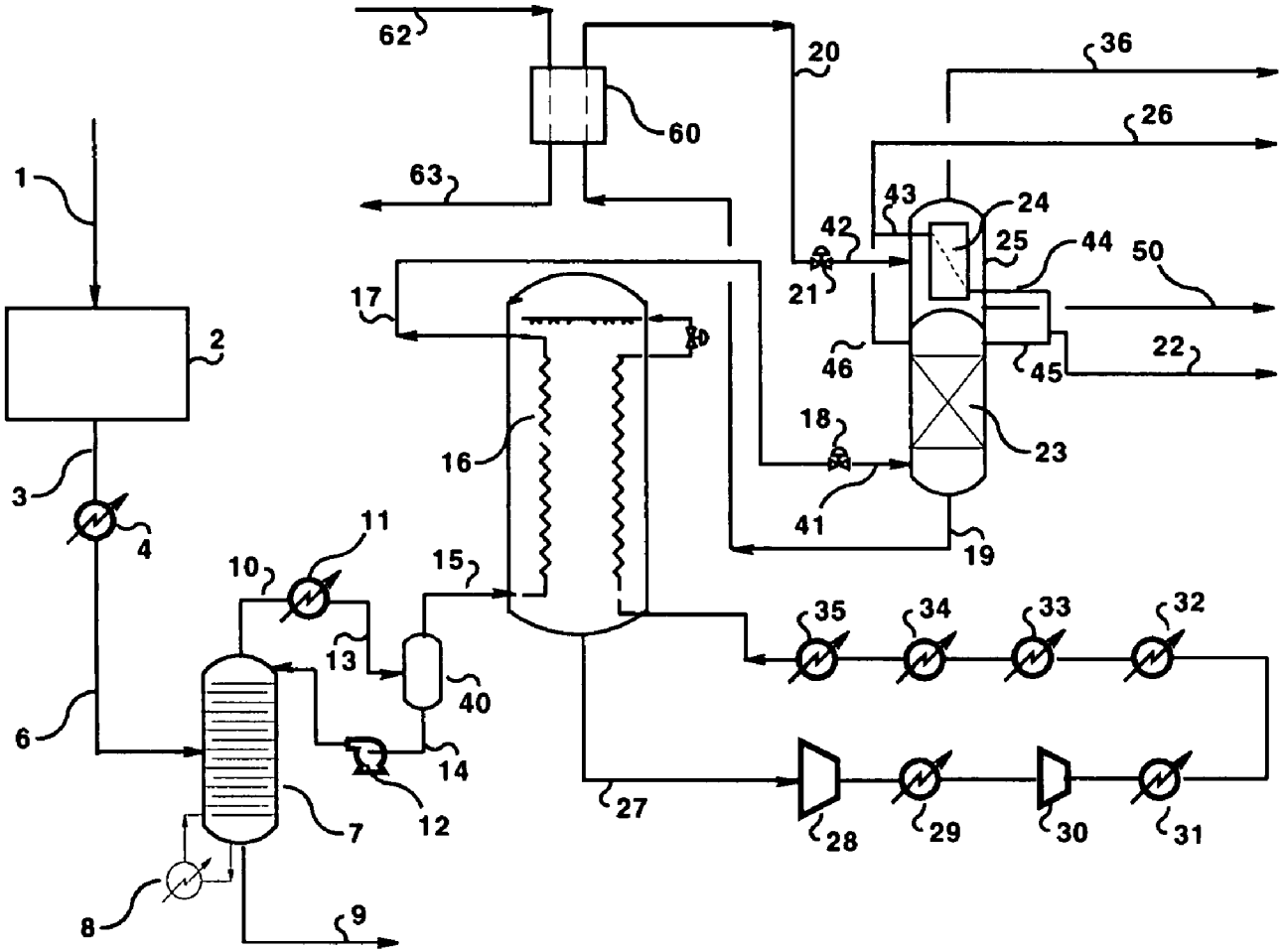
FIG. 4 a simplified process flow diagram showing a modification of the embodiment of FIG. 1 in which the second part of the spool wound heat exchanger is replaced by a separate heat exchanger 60.

The embodiment of FIG. 4 differs from that of FIG. 1 in that the second part of the heat exchanger 16 is replaced by a separate heat exchanger 60. Each of the heat exchangers 16 & 60 use a different refrigeration fluid. The bottoms liquid 19 from the nitrogen-rejection column 23 passes to the heat exchanger 60 in which it is cooled against a suitable third level refrigerant 62, 63 that can be a mixed refrigerant or a pure fluid such as nitrogen. The cold LNG stream 20 from the heat exchanger 60 provides the feed to the flash drum 25.

A further embodiment of this invention relates to the recovery of an enriched crude helium stream from the overhead vapour 46 of the nitrogen-rejection column 23. The discharged portion 26 of the overhead vapour 46 in the embodiment of, for example, FIG. 1 is typically at a pressure in the region of 220 psia (1.5 MPa) and a temperature of −258° F. (−161° C.). If the feed gas contains helium, a significant portion of that helium in the feed gas is contained in this stream 26 and can be easily extracted from stream 26 with the processing scheme of FIG. 5. Stream 26 is cooled against a returning nitrogen stream 76 and a helium stream 73 in a heat exchanger 70. Stream 71 leaves heat exchanger 70 partially condensed and is separated into a liquid fraction 75 and a vapour fraction 73 in a separator pot 72. Stream 73, which is substantially helium, is rewarmed in heat exchanger 70 and the resultant crude helium stream 78 exported for further purification. Stream 75, which is substantially nitrogen, is reduced in pressure across a valve 74 and the resultant cooled stream 76 is rewarmed in the heat exchanger 70 and the resultant stream 77 can be rewarmed to recover further refrigeration before venting to atmosphere.

EXAMPLE 1

This Example is based on the embodiment of FIG. 1. The LNG process is supplied with 88,000 lbmol/h (40,000 kgmol/h) feed natural gas at ambient temperature and 900 psia (6.2 MPa) pressure containing 4.8 mol % nitrogen, the balance being mainly methane. The feed gas is dried and precooled and pretreated in separation column 7 such that it enters heat exchanger 16 at a temperature of −38° F. (−39° C.) and a pressure of about 850 psia (5.8 MPa). Stream 17 leaves heat exchanger 16 at a temperature of −178° F. (−116.5° C.) and is let down in pressure to 220 psia (1.5 MPa) before feed to nitrogen-rejection column 23, which operates at 220 psia (1.5 MPa). Stream 19 is withdrawn from the bottom of the column 23 and is further cooled to −247° F. (−155° C.) in heat exchanger 16. Stream 20 leaving the heat exchanger 16 is then let down to low pressure into flash drum 25. Product LNG stream 50 is withdrawn from flash drum 25 at a temperature of −261° F. (−163° C.) with a nitrogen content of less than 1.5 mol %. Fuel Stream 36 is withdrawn from flash drum 25 with a flowrate of 7,900 lbmol/h (3,600 kgmol/h) with a nitrogen content of 30 mol %. Nitrogen vent stream 26 is withdrawn from the top of column 23 with a flowrate of 600 lbmol/h (272 kgmol/h), a nitrogen content of 98.0 mol % and a temperature of −257° F. (−160.5° C.).

EXAMPLE 2

Figure 5:
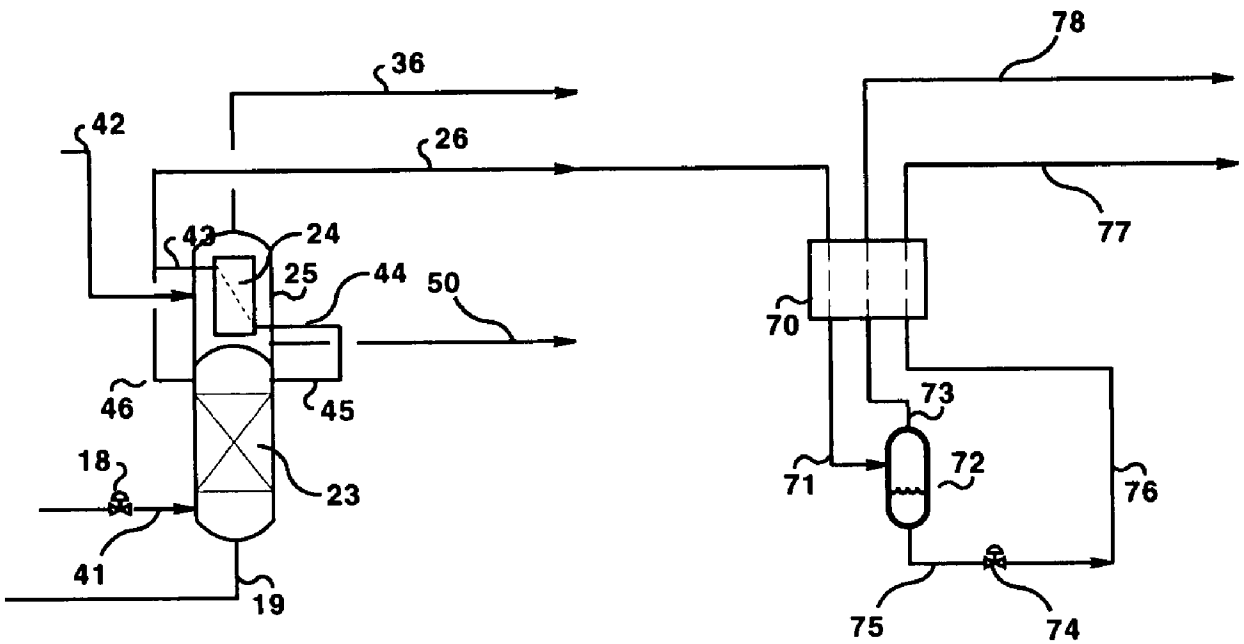
FIG. 5 a simplified process flow diagram showing a modification of the embodiment of FIG. 1 for recovering helium from the LNG.

This Example is based on the embodiment of FIG. 1 with the enhancement of crude helium extraction of FIG. 5. The LNG process is supplied with 88,000 lbmol/h (40,000 kgmol/h) feed natural gas at ambient temperature and 900 psia (6.2 MPa) pressure containing 4.8 mol % nitrogen and 600 ppmv helium, the balance being mainly methane. The feed gas is dried and precooled and pretreated in separation column 7 such that it enters heat exchanger 16 at a temperature of −38° F. (−39° C.) and pressure of about 850 psia (5.9 MPa). Stream 17 leaves heat exchanger 16 at a temperature of −178° F. (−116.5° C.) and is let down in pressure to 220 psia (1.5 MPa) before feed to nitrogen column 23, which operates at 220 psia (1.5 MPa). Stream 19 is withdrawn from the bottom of the column 23 and is further cooled to −247° F. (−155° C.) in heat exchanger 16. Stream 20 leaving the heat exchanger 16 is then let down to low pressure into flash drum 25. Product LNG stream 50 is withdrawn from flash drum 25 at a temperature of −261° F. (−163° C.) with nitrogen content of less than 1.5 mol %. Fuel Stream 36 is withdrawn from flash drum 25 with a flowrate of 7,900 lbmol/h (3,600 kgmol/h) with a nitrogen content of 30 mol %. Nitrogen vent stream 26 is withdrawn from the top of column 23 with a flowrate of 710 lbmol/h (322 kgmol/h), a nitrogen content of 98.0 mol %, a temperature of −259° F. (−161.5° C.), and a pressure of 220 psia (1.5 MPa). Referring to FIG. 5, stream 26 is cooled in heat exchanger 70 against returning streams 73 and 76 to a temperature of −298° F. (−183.5° C.) and separated into liquid and vapour streams in separator 72. The liquid stream is let down to low pressure providing Joule Thomson refrigeration with stream 76 reaching a temperature of −310° F. (−190° C.). Both liquid stream 76 and vapour stream 73 are rewarmed in exchanger 70. Stream 77 is the nitrogen vent stream with flow of 656 lbmol/h (297.5 kgmol/h) and nitrogen content of 97.5%. Stream 78 is the crude helium product stream with a flow of 54 lbmol/h (24.5 kgmol/h) with helium concentration of 74 mol %

It will be appreciated that the invention is not restricted to the details disclosed above in respect of the exemplified embodiments and that numerous modifications and variations can be made without departing from the spirit and scope of the invention.

The invention claimed is:

1. A method of preparing a nitrogen-freed liquefied natural gas stream comprising liquefying a nitrogen-containing natural gas, using work provided by a gas turbine, to provide a nitrogen-containing liquified natural gas stream and subjecting said liquefied gas stream to a first fractionation in a distillation column to provide a first nitrogen-enriched overhead vapor stream and a nitrogen-containing bottoms liquid stream; sub-cooling, using refrigeration duty provided by a refrigerant fluid not derived from the liquefied natural gas feed, and pressure reducing at least a portion of said bottoms liquid stream; subjecting said sub-cooled, pressure reduced portion to a second fractionation in a flash drum to provide a second nitrogen-enriched overhead vapor stream that is of lower purity than said first overhead vapor stream and a purified liquefied natural gas stream; condensing a portion of the first nitrogen-enriched overhead vapor stream in said flash drum to provide heat duty therein and produce a condensed nitrogen-enriched overhead stream; and returning at least a portion of said condensed nitrogen-enriched overhead stream as reflux to the distillation column, and the second, but not the first of said nitrogen-enriched overhead vapor streams is used as, or added to, a fuel gas used in said gas turbine providing work for use in connection with liquefaction of the natural gas feed.

2. A method as claimed in claim 1, wherein the entire nitrogen-containing bottoms liquid stream is fed to the flash drum.

3. A method as claimed in claim 1, wherein only a portion of the sub-cooled nitrogen-containing bottoms liquid stream is fed to the flash drum and the remainder is fed to a second flash drum for separation into a third nitrogen-enriched overhead vapor stream that is of lower purity than said first overhead vapor stream (46) and a second purified liquefied natural gas stream.

4. A method as claimed in claim 1, wherein the first nitrogen-enriched overhead vapor stream has a nitrogen concentration in excess of 95 mol %.

5. A method as claimed in claim 1, wherein the nitrogen-containing natural gas is liquefied in a spiral-wound heat exchanger having liquefaction and sub-cooling sections, the nitrogen-containing liquefied natural gas stream is withdrawn after the liquefaction section and the bottoms liquid stream from the distillation column is sub-cooled in said sub-cooling section.

6. A method of preparing a nitrogen-freed liquefied natural gas stream comprising:

feeding a nitrogen-containing natural gas stream to a spiral-wound heat exchanger having liquefaction and sub-cooling sections in which heat exchanger refrigeration duty is provided by a recycling refrigerant system to which work is supplied by a gas turbine powered by a fuel gas;

withdrawing a liquefied gas stream after said liquefaction section;

subjecting said liquefied gas stream to a first fractionation in a distillation column to provide a first nitrogen-enriched overhead vapor stream and a nitrogen-containing bottoms liquid stream;

sub-cooling at least a portion of said bottoms liquid stream in said sub-cooling section and pressure reducing said portion;

subjecting said pressure-reduced portion to a second fractionation in a flash drum to provide a second nitrogen-enriched overhead vapor stream that is of lower purity than said first overhead vapor stream and a purified liquefied natural gas stream;

condensing a portion of the first nitrogen-enriched overhead vapor stream in said flash drum to provide heat duty therein and produce a condensed nitrogen-enriched overhead stream;

returning at least a portion of said condensed nitrogen-enriched overhead stream as reflux to the distillation column and using said second nitrogen-enriched overhead vapor stream as at least a component of the fuel gas.

7. An apparatus for preparing a nitrogen-freed liquefied natural gas stream by a process as claimed in claim 1, said apparatus comprising:

a refrigeration system for liquefying the nitrogen-containing natural gas feed;

a gas turbine providing work for use in connection with said refrigeration system;

a distillation column;

a flash drum;

a condenser within said flash drum;

a heat exchanger for receiving refrigeration duty from a refrigeration fluid;

conduit means for feeding nitrogen-containing liquefied natural gas from the refrigeration system to the distillation column;

conduit means for removing the first nitrogen-enriched overhead vapor stream from the distillation column;

conduit means for conveying a portion of the first nitrogen-enriched overhead vapor stream to the condenser;

conduit means for returning condensed first nitrogen-enriched overhead vapor stream from the condenser to the distillation column as reflux;

conduit means for conveying the nitrogen-containing bottoms liquid stream from the distillation column to the heat exchanger; conduit means for conveying the sub-cooled nitrogen-containing bottoms liquid stream from the heat exchanger to the flash drum at reduced pressure;

conduit means for removing the second nitrogen-enriched overhead vapor stream from the flash drum;

conduit means for removing the purified liquefied natural gas stream from the flash drum and conduit means for feeding the second nitrogen-enriched overhead vapor stream to the gas turbine as a fuel gas feed thereto.

8. An apparatus as claimed in claim 7, wherein the refrigeration system comprises a spiral-wound heat exchanger having liquefaction and sub-cooling sections; the conduit means for feeding nitrogen-containing liquefied natural gas to the distillation column withdraws said stream from said heat exchanger after the liquefaction section; and said sub-cooling section constitutes the heat exchanger in which the nitrogen-containing bottoms liquid stream from the distillation column is sub-cooled.

9. A method as claimed in claim 6, wherein the entire nitrogen-containing bottoms liquid stream is fed to the flash drum.

10. A method as claimed in claim 6, wherein only a portion of the sub-cooled nitrogen-containing bottoms liquid stream is fed to the flash drum and the remainder is fed to a second flash drum for separation into a third nitrogen-enriched overhead vapor stream that is of lower purity than said first overhead vapor stream and a second purified liquified natural gas stream.

11. A method as claimed in claim 6, wherein the first nitrogen-enriched overhead vapor stream has a nitrogen concentration in excess of 95 mol %.

* * * * *